United States Patent [19]

Hirai

[11] Patent Number: 4,892,489

[45] Date of Patent: Jan. 9, 1990

[54] FLAT-CABLE CONNECTOR

[75] Inventor: Yuji Hirai, Tokyo, Japan

[73] Assignee: Honda Tsushin Kogyo Co., Ltd., Tokyo, Japan

[21] Appl. No.: 304,528

[22] Filed: Feb. 1, 1989

[30] Foreign Application Priority Data

Jul. 28, 1988 [JP] Japan ..... 63-186755

[51] Int. Cl.[4] ..... H01R 9/07

[52] U.S. Cl. ..... 439/497

[58] Field of Search ..... 439/92, 607, 492, 495, 439/497

[56] References Cited

U.S. PATENT DOCUMENTS

| | | | |
|---|---|---|---|
| 4,352,531 | 10/1982 | Gutter | 439/497 |
| 4,406,512 | 9/1983 | Schell | 439/497 |
| 4,408,823 | 10/1983 | Huber | 439/497 |
| 4,596,428 | 6/1986 | Tengler | 439/497 |

*Primary Examiner*—Joseph H. McGlynn
*Attorney, Agent, or Firm*—Armstrong, Nikaido, Marmelstein, Kubovcik & Murray

[57] ABSTRACT

Disclosed is a flat-cable connector comprising: a cable cover having a comb-shaped arrangement of first ridges, each ridge having a longitudinal groove made at its top for accommodating a selected grounding conductor and a lateral groove made at its top for accommodating a selected grounding terminal; and a comb-shaped arrangement of second ridges, each ridge having a longitudinal groove made at its top for accommodating a selected signal conductor and a lateral groove made at its top for accommodating a selected signal terminal, said first ridges confronting the inter-ridge spaces of said second ridges and vice versa; a cable housing having a comb-shaped arrangement of staggered ribs, which are adapted to fit in the staggered inter-ridge spaces of said cable cover; a grounding contact assembly comprising a common grounding plate and a plurality of upright grounding terminals in the form of press contact; and a plurality of press contact terminals; said cable cover having said grounding contact assembly assembled thereto with each upright grounding terminal inserted in each lateral groove of each of said first ridges, and each of said press contact terminals being inserted in each lateral groove of each of said second ridges. This structure permits simultaneous connection between all signal and grounding conductors of a flat cable to corresponding contacts and the common grounding plate of the flat cable connector.

6 Claims, 5 Drawing Sheets

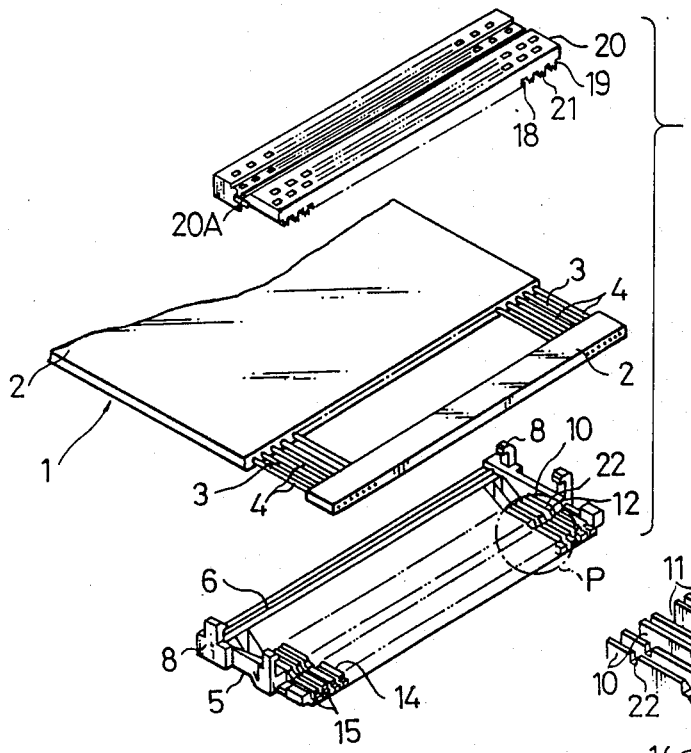
FIG. 6
FIG. 7
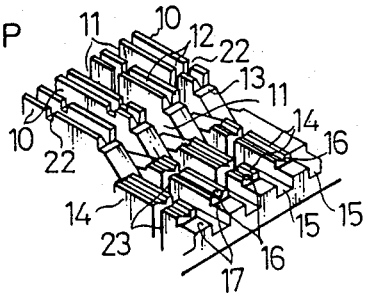
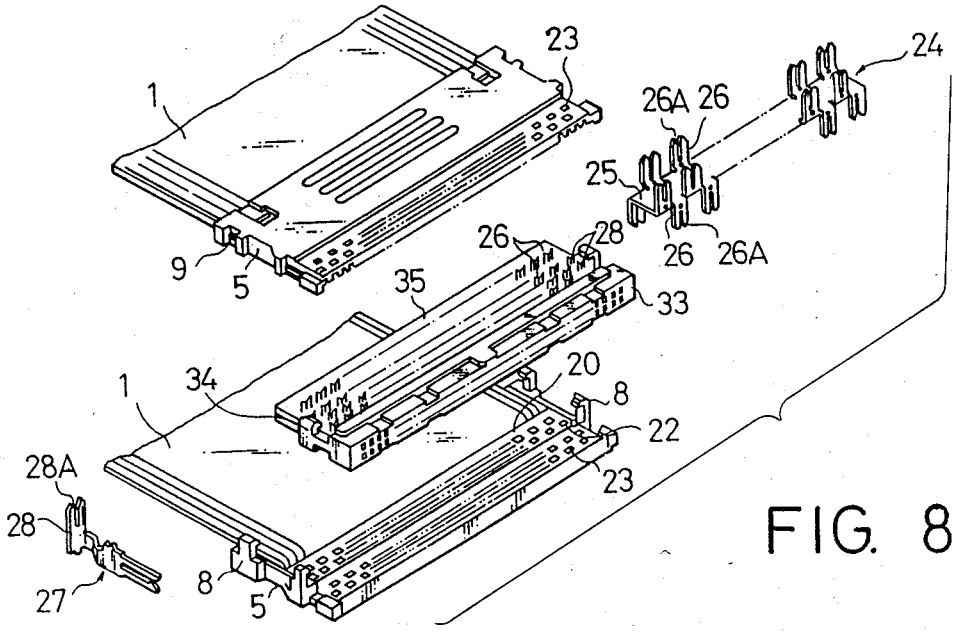
FIG. 8

FIG. 12
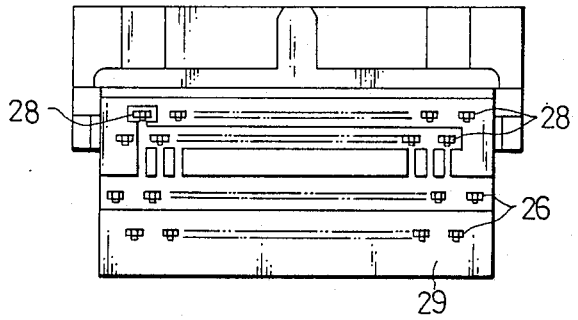
FIG. 13(A)
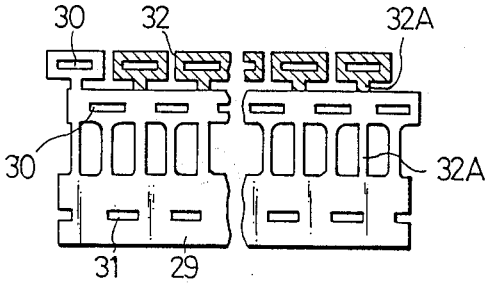
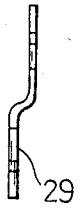
FIG. 13(B)

FIG. 14
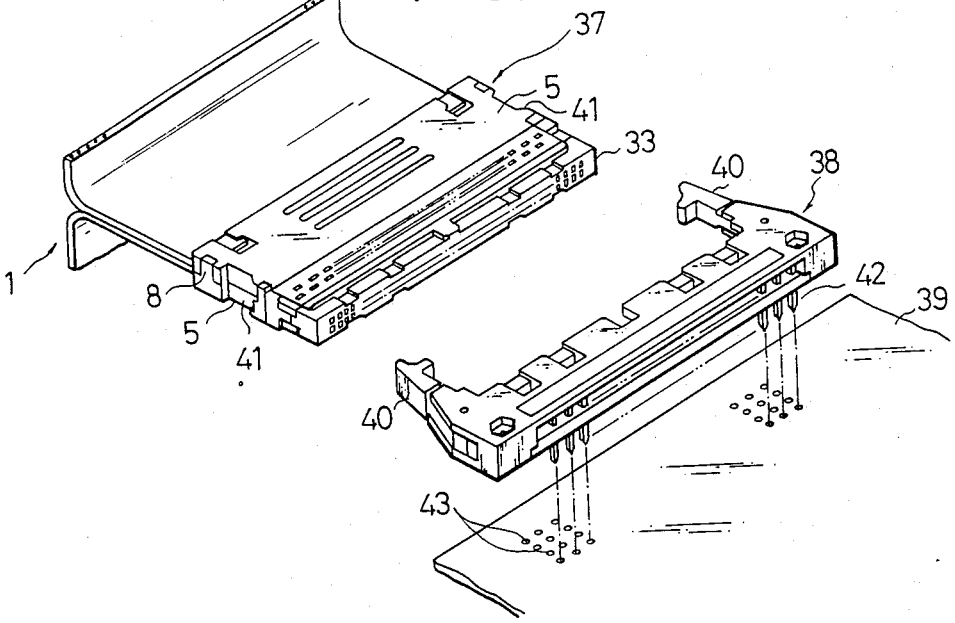
FIG. 15(A)
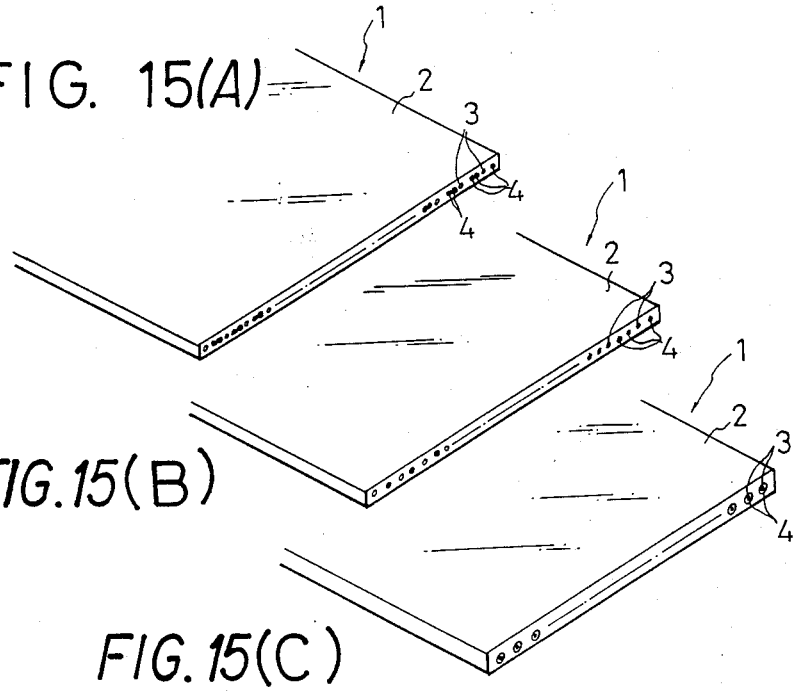
FIG. 15(B)
FIG. 15(C)

FLAT-CABLE CONNECTOR

BACKGROUND OF THE INVENTION

1. Field of the Invention

The present invention relates to a flat-cable connector for use in connecting to a flat-cable having a plurality of signal conductors arranged at regular intervals each accompanying a grounding conductor.

2. Related Art

FIG. 15 shows conventional flat cables, which are generally indicated at 1. Particularly, FIG. 15 (A) shows a flat cable as having in its flat sheath 2, a plurality of signal conductors 3 each having a grounding conductor 4 on either side, two adjacent grounding conductors being contacted together. FIG. 15 (B) shows a flat cable as having a plurality of signal conductors 3 each having a grounding conductor 4 on either side, two adjacent grounding conductors separated from each other. FIG. 15 (C) shows a flat cable as having a plurality of signal conductors 3 each enclosed by a coaxial grounding conductor.

In connecting such a flat cable 1 to a connector the stripped ends of signal and grounding conductors of the flat cable are arranged in alignment with associated conductors of the cable, and are soldered or spot-welded to these contacts without being firmly supported in the connector housing of the connector.

Soldering or spot-welding of many signal and grounding conductors is a laborious and time-consuming work. Still disadvantageously, there is a fear of short-circuiting between adjacent conductors, which can be inadvertently spanned by solder.

SUMMARY OF THE INVENTION

With the above in mind one object of the present invention is to provide a flat-cable connector which makes it possible to connect a plurality of signal and grounding conductors to associated contacts of the connector at an increased efficiency without a fear of short-circuiting between adjacent conductors by solder no matter how compact the conductors are arranged in the flat cable.

To attain this object a flat-cable connector according to a first aspect of the present invention comprises: a cable cover having a plurality of first ridges arranged at intervals in the form of comb-teeth and integrally connected to the inner surface of the cable cover, each ridge having a longitudinal groove made at its top for accommodating a selected grounding conductor and a lateral groove made at its top for accommodating a selected grounding terminal; and a plurality of second ridges arranged at intervals is the form of comb-teeth and integrally connected to the inner surface of the cable cover, each ridge having a longitudinal groove made at its top for accommodating a selected signal conductor and a lateral groove made at its top for accommodating a selected contact terminal, said first ridges confronting the inter-ridge spaces of said second ridges and vice versa; a cable housing having staggered ribs arranged at intervals in the form of comb-teeth and integrally connected to the under surface of the cable housing, said staggered ribs being adapted to fit in the staggered inter-ridge spaces of said cable cover; a grounding contact member comprising a common grounding plate and a plurality of upright grounding terminals integrally connected to the common grounding plate, each terminal having a pinch slit made at its top; and a plurality of press contact terminals; said cable cover having said grounding contact member assembled thereto with each upright grounding terminal inserted in each lateral groove of each of said first ridges, and each of said press contact terminals being inserted in each lateral groove of each of said second ridges.

According to a second aspect of the present invention a flat-cable connector has a cable cover having a plurality of first and second staggered ridges arranged at intervals in the form of comb-teeth and integrally connected to the inner surface of the cable cover, said first ridges being higher than said second ridges.

According to a third aspect of the present invention a flat-cable connector has first and second ridges each terminating with a cutting block at the front end of its longitudinal groove.

According to a fourth aspect of the present invention the cable housing of a flat-cable connector has a short-circuit contact connected to selected press contacts and selected grounding contacts.

According to fifth aspect of the present invention an assembly of said cable cover and cable housing and another assembly of said cable cover and cable housing are laid on each other, and are jointed together with their cable housings inside.

According to a sixth aspect of the present invention an assembly of said cable cover and cable housing and another assembly of said cable cover and cable housing are laid on each other, and are jointed together with their cable housings inside, using a grounding contact member commonly.

With the arrangement of the flat-cable connector according to the first aspect of the present invention each grounding conductor of the flat cable can be put in the longitudinal groove of each first ridge of the cable cover, and each grounding conductor can be held fixedly when the cable cover and the cable housing are assembled together with their ridges interdigitally jointed. Then, adjacent grounding conductors in adjacent first ridges of the cable cover are isolated by the corresponding intervening ridge in the cable housing.

All grounding conductors can be simultaneously grounded by applying a grounding contact member to the cable cover with its upright grounding terminals inserted into the lateral grooves of the first ridges of the cable cover. Then, the grounding conductors are pushed into the pinch slits of the upright grounding terminals, which are integrally connected to the common grounding plate.

Likewise, each signal conductor of the flat cable can be put in the longitudinal groove of each second ridge of the cable cover, and each signal conductor can be held fixedly when the cable cover and the cable housing are assembled together with their ridges interdigitally jointed. Then, adjacent signal conductors in adjacent second ridges of the cable cover are isolated by the corresponding intervening ribs of the cable housing. All signal conductors can be automatically connected to associated contacts by inserting these contacts in the lateral grooves of the second ridges of the cable cover until their pinch slots catch the signal conductors.

The first and second groups of ridges are staggered in the lateral direction, thereby permitting connections of signal and grounding conductors at such separate positions that necessary connections may be effected without causing any disturbance. Also, the staggering arrangement of the first and second groups of ridges permits reduction of inter-ridge spaces to possible minimum without deteriorating the insulation between adjacent signal and grounding conductors, and accordingly reduction of the width of the connector.

With the arrangement of the flat-cable connector according to the second aspect of the present invention the grounding and signal conductors can be set on the first and second ridges at different levels. The arrangement of the first and second ridges at different levels in addition to the lateral staggering arrangement has a effect to reduce disturbance in setting the grounding and signal conductors, thus permitting easy setting of conductors.

With the arrangement of the flat-cable connector according to the third aspect of the present invention, extra lengths of the grounding and signal conductors can be simultaneously cut and removed by descending a cutter blade to the cutting plateaus ahead of the longitudinal grooves in which the conductors are laid.

With the arrangement of the flat-cable connector according to the fourth aspect of the present invention selected signal conductors can be used as grounding conductors to meet occasional demands.

With the arrangement of the flat-cable connector according to the fifth aspect of the present invention two flat cables can be connected to a single connector.

With the arrangement of the flat-cable connector according to the sixth aspect of the present invention the number of necessary parts in connecting two flat cables can be reduced to minimum.

Other objects and advantages of the present invention will be understood from the following description of a flat-cable connector according to one embodiment of the present invention, which is shown in accompanying drawings.

BRIEF DESCRIPTION OF THE DRAWINGS

FIG. 6 is a perspective exploded or disassembled view of the flat-cable connector;

FIG. 7 is an enlarged view of the part encircled by broken line and indicated by "P" in FIG. 6;

FIG. 8 is a perspective exploded or disassembled view of the flat-cable connector, showing its construction in detail;

FIG. 12 is a plane view of the flat-cable connector with a short-circuit contact member attached;

FIG. 13 (A) is a plane view of a short-circuit contact member;

FIG. 13 (B) is a side view of the short-circuit contact member;

FIG. 14 is a perspective view of a flat-cable connector, a flat-cable and a printed circuit board, showing how the flat cable is connected to the printed circuit board with the aid of the flat-cable connector; and FIGS. 15 (A), (B) and (C) show different flat cables.

PREFERRED EMBODIMENT OF THE INVENTION

Figure 1:
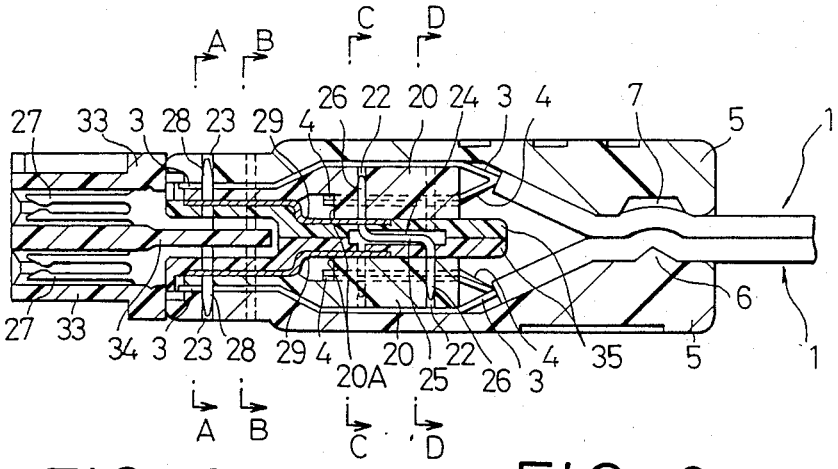
FIG. 1 is a longitudinal section of a flat-cable connector according to the embodiment of the present invention.
Figure 2:
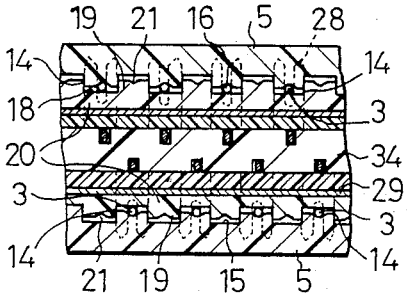
FIG. 2 is a cross section of the flat-cable connector taken along the line A—A in FIG. 1.
Figure 3:
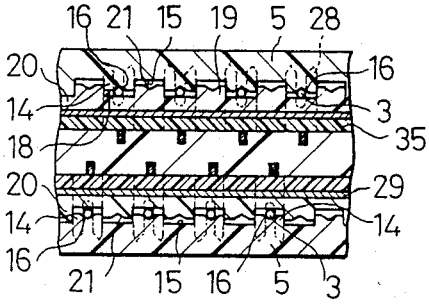
FIG. 3 is a cross section of the flat-cable connector taken along the line B—B in FIG. 1.
Figure 4:
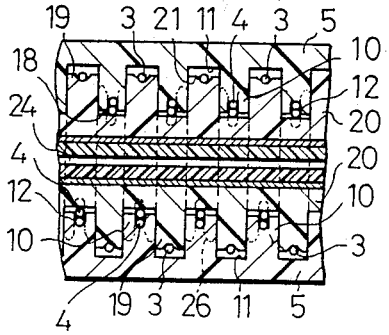
FIG. 4 is a cross section of the flat-cable connector taken along the line C—C in FIG. 1.
Figure 5:
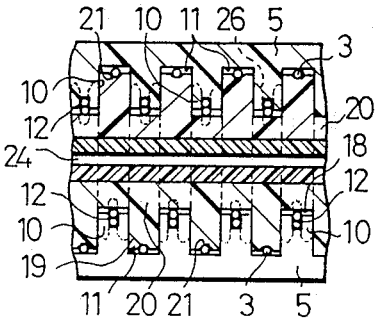
FIG. 5 is a cross section of the flat-cable connector taken along the line D—D in FIG. 1.
Figure 9:
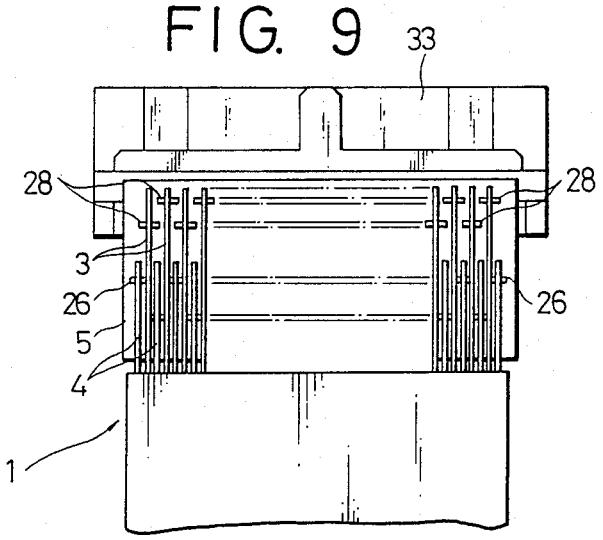
FIG. 9 is a plane view of the flat-cable connector prior to applying an associated cable cover.

FIGS. 1 to 14 show a flat-cable connector according to one embodiment of the present invention. As shown in FIG. 1, it has a pair of cable covers 5 sandwiching the ends of two flat cables 1. One of these cable covers has a male projection 6 whereas the other cable cover has a female recess 7. With this arrangement the cables 1 will be prevented from slipping off from the flat-cable connectors when integrated together by catching the engagement recesses 9 of the first connector by the hooks 8 of the second connector as seen from FIG. 8. Each cable cover 5 has a comb-shaped array of first ridges 10 integrally connected to its inner surface. These first ridges 10 are arranged at regular intervals, defining grooves 11. Each first ridge has a slot 12 made on its top for accommodating a grounding conductor 4. In this particular example two adjacent grounding conductors 4 are laid in a single slot 12. Each first ridge has a cutting plateau 13 ahead of the end of the slot and a descending slope consecutive thereto.

Also, each cable cover has a comb-shaped array of second ridges 14 integrally connected to its inner surface. These second ridges 14 are arranged alternately with the first ridges 10 so that the second ridges confront the inter-spaces or grooves 11 of the first ridges 10 and vice versa. Each second ridge 14 has a slot 16 made on its top accommodating a signal conductor 3. Each second ridge has a cutting plateau 17 ahead of the end of the slot. As seen from FIG. 7, the first ridges 10 are higher than the second ridges 14.

The cable housing 20 has two staggered arrays of ribs 19 arranged in reversed relationship with the ridge-and-groove arrangement in the cable cover 5. Thus, the cable cover 5 and the cable housing 20 can be integrated with their ridges or ribs and grooves meshed interdigitally with each other. As seen from FIGS. 1, 10 and 11, the cable housing 20 has notched steps 20A to allow the ends of grounding conductors 4 to appear ahead of the grooves 12 of the first ridges 10 on the upper side of the cable housing 20. Each rib 19 has a conductor pressing groove 21 made at its end for pinching a signal or grounding conductor 3 or 4.

The array of first ridges have lateral staggered grooves 22 crossing their slots 12, and the array of second ridges have lateral staggered grooves 23 crossing their slots 16. These staggered grooves 22 accommodate grounding terminals, and the staggered grooves 23 accommodate contact terminals.

As shown in FIG. 8, a grounding contact member 24 comprises a common grounding plate 25 and a plurality of upright staggered grounding terminals 26 integrally connected to the common grounding plate 25. Each grounding terminal has a pinch slit 26A made at its top in the form of press contact. The grounding contact member 24 can be assembled to the opposite cable housings 20 with each upright grounding terminal 26 inserted in each lateral groove 22 of each of the first ridges 10, and then each upright grounding terminal 26 has its pinch slit 26A in alignment with the slot of each first ridge 10.

A plurality of press contact terminals 28 are used. Each press contact terminal 28 has upright and lateral contact pieces 27. Each piece has a pinch slit for pressfitting associated conductors. Each press contact terminal can be inserted in each lateral groove 23 of each second ridge with the pinch slit 28A of the upright contact piece in alignment with the slot of each second ridge 16.

Each cable housing 20 has a slot-circuit contact member 29 connected to selected press contacts 28 and selected grounding press contacts 26, thereby grounding the selected press contacts 28. As seen from FIGS. 1, 12 and 13 the short-circuit contact member 29 has a plurality of apertures 30 and a plurality of apertures 31 allotted to press contacts 26 and grounding contacts 28, respectively. It has a plurality of tabs 32 with apertures 30. These tabs are integrally connected to the apertured plate 29 by narrow bridges 32A for facilitating the removal of unnecessary tabs (shaded in FIG. 13A) from the plate 29. In this particular embodiment each press contact 27 is attached to a separate contact housing 33, which has an elongation 34 for inserting in and locking with the cable cover 5. As seen from FIG. 1, the grounding plate 25 is sandwiched between a pair of spacers 35, which are in turn sandwiched between the opposite cable housings 20.

Figure 10:
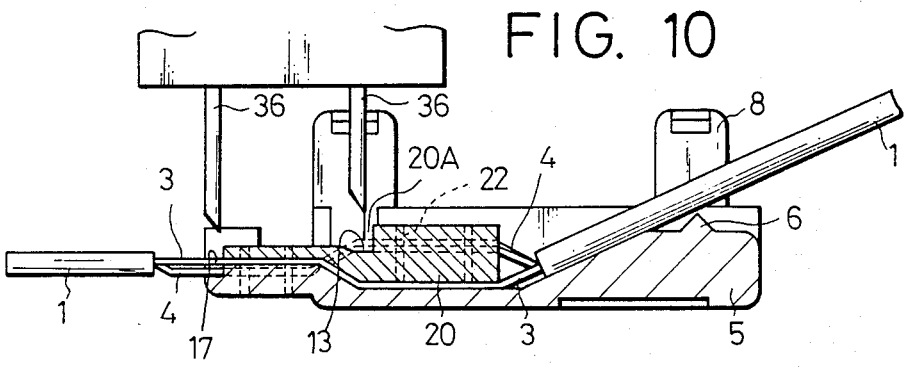
FIGS. 10 and 11 show how conductors are cut and removed.
Figure 11:
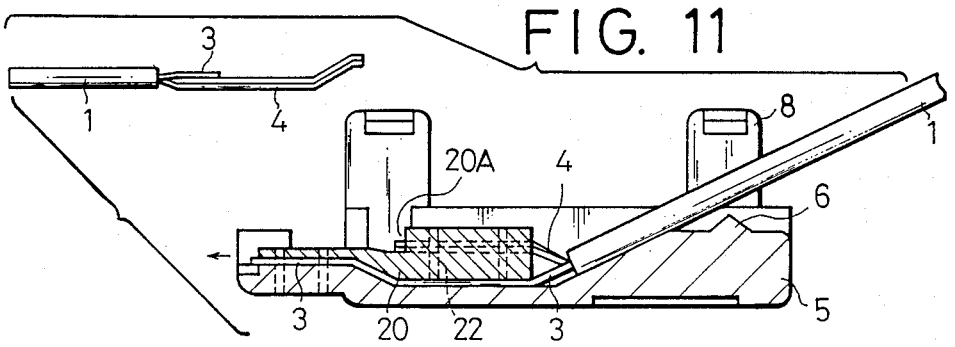

In assembling, first the lateral press contact pieces of all press contact terminals 27 are inserted in the rear part of the contact housing 33, and the elongation of the contact housing 33 is sandwiched between a pair of spacers 35 with the upright press contact pieces of the press contact terminals 27 appearing outside. Also, the grounding plate 25 of the grounding contact member 24 is sandwiched between the opposite spacers 35 with the upright grounding terminals 26 appearing outside. As shown in FIG. 6, a flat cable 1 is stripped near its terminal end to expose its signal and grounding conductors 3 and 4, leaving the sheath 2 of the cable at its extremity for the purpose of keeping these conductors in order. Then, the grounding conductors 4 of the cable 1 are laid in the slots 12 of the first ridges 10 and the inter-ridge spaces or grooves 15 of the cable cover 5, as shown in FIG. 10. Likewise, the signal conductors 3 of the cable 1 are laid in the inter-ridge spaces or grooves 11 and the slots 16 of the second ridges 14 of the cable cover 5. The grounding conductors 4 extend beyond the inter-ridge spaces 15 of the cable cover 5. Thanks to the different levels of the first and second ridges the grounding and signal conductors can be easily set in place without tangling. After finishing the setting of the conductors in place a cable housing 20 is applied to the cable cover 5 with their ridges and ribs interlocked interdigitally. Specifically, the first ridges 10 of the cable cover 5 are inserted in the inter-rib spaces 18 of the cable housing 20; the ribs 19 of the cable housing 20 are inserted in the first interridge spaces 11 of the cable cover 5; the second ridges 14 of the cable cover 5 are inserted in the inter-rib spaces 15 of the cable housing 20; and the ribs 19 of the cable housing 20 are inserted in the second inter-ridge spaces 15 of the cable cover 5. Thus, the grounding conductors 4 are caught by the first ridges 10 of the cable cover 5 and the inter-rib spaces 15 of the cable housing 20, and are isolated from each other by the ribs 19 of the cable housing 20. Likewise, the signal conductors 3 are caught by the second ridges 14 of the cable cover 5 and the inter-rib spaces 18 of the cable housing 20, and are isolated from each other by the ribs 19 of the cable housing 20. Thus, all signal and grounding conductors are separated horizontally and vertically, and fixedly held and isolated from each other by the cable cover 5 and the cable housing 20. Then, a pair of cutter blades 36 are descended to the cutting plateaus 13 and 17 ( FIG. 10) to cut and remove undesired lengths of the conductors 3 and 4 simultaneously (FIG. 11). This cutting operation is performed formed in each cable cover-and-cable housing set. Then, two sets are put on the opposite surfaces of the spacer 35 with the upright press contact terminals 28 and press contact grounding terminals 26 of the cable cover 5 inserted in the apertures 23 and 22 of the spacer 35. Then, all signal conductors 3 are press-fitted into the slots 28A of the press contact pieces of the press contacts 28, and all grounding conductors 4 are pressfitted into the slots 26A of the press contact pieces of the grounding terminals 26. The cable covers 5 are integrated by their hooks 8 and engagement recesses 9.

FIG. 14 shows how the flat-cable connector 37 is used to connect a flat cable 1 to a printed circuit board 39 with the aid of an associated interface connector 38. In this case the interface connector 38 is integrated with the flat-cable connector 37 by catching the engagement recesses 41 of the flat-cable connector 37 by the hooks 40 of the interface connector 38. The flat cable 1 can be connected to the printed circuit board 39 by inserting the contact pins 42 of the interface connector 38 in the receptacle apertures 43 of the printed circuit board 39.

A flat-cable connector according to the present invention is described above as being applied to two flat cables, but as a matter of course it can be applied to a single flat cable. A cable cover 5 may have an extension to contain press contacts, and then no contact housing 33 is necessary. A short-circuit contact member 29 may be used only when occasions demand.

What is claimed is:

1. A flat-cable connector for use in connecting to a flatcable having a plurality of signal conductors arranged at regular intervals each accompanying a grounding conductor comprising:

a cable cover having a plurality of first ridges arranged at intervals in the form of comb-teeth and integrally connected to the inner surface of the cable cover, each ridge having a longitudinal groove made at its top for accommodating a selected grounding conductor and a lateral groove made at its top for accommodating a selected grounding terminal; and a plurality of second ridges arranged at intervals in the form of the comb-teeth and integrally connected to the inner surface of the cable cover, each ridge having a longitudinal groove made at its top for accommodating a selected signal conductor and a lateral groove made at its top for accommodating a selected contact terminal, said first ridges confronting the inter-ridge spaces of said second ridges and vice versa;

a cable housing having staggered ribs arranged at intervals in the form of comb-teeth and integrally connected to the under surface of the cable housing, said staggered ribs being adapted to fit in the staggered inter-ridge spaces of said cable cover;

a grounding contact member comprising a common grounding plate and a plurality of upright grounding terminals integrally connected to the common grounding plate, each terminal having a pinch slit made at its top; and a plurality of press contact terminals;

said cable cover having said grounding contact assembly assembled thereto with each upright grounding terminal inserted in each lateral groove of each of said first ridges, and each of said press contact terminals being inserted in each lateral groove of each of said second ridges.

2. A flat-cable connector claimed in claim 1 wherein said first ridges are at a level which is higher than said second ridges.

3. A flat-cable connector claimed in claim 2 wherein each of said first ridges terminates with a cutting block at the front end of the longitudinal groove, and each of said second ridges terminates with a cutting plateau at the front end of the longitudinal groove.

4. A flat-cable connector claimed in claim 1 wherein said cable housing has a short-circuit contact member connected to selected press contacts and selected grounding contacts.

5. A flat-cable connector claimed in claim 1 wherein an assembly of said cable cover and cable housing and another assembly of said cable cover and cable housing are laid on each other, and are joined together with their cable housings inside.

6. A flat-cable connector claimed in claim 5 wherein said assemblies have a grounding contact assembly commonly used.

* * * * *